US010645477B2

(12) United States Patent
Lalvani

(10) Patent No.: US 10,645,477 B2
(45) Date of Patent: May 5, 2020

(54) AUDIO SYSTEMS

(71) Applicant: Binatone Electronics International Ltd., Hong Kong (CN)

(72) Inventor: Dino Lalvani, Hong Kong (CN)

(73) Assignee: Binatone Electronics International Ltd., Sheung Wan (HK)

( * ) Notice: Subject to any disclaimer, the term of this patent is extended or adjusted under 35 U.S.C. 154(b) by 0 days.

(21) Appl. No.: 15/487,096

(22) Filed: Apr. 13, 2017

(65) Prior Publication Data

US 2017/0303028 A1 Oct. 19, 2017

(30) Foreign Application Priority Data

Apr. 13, 2016 (GB) ..... 1606503.9

(51) Int. Cl.
*H04R 1/10* (2006.01)
*H04R 5/033* (2006.01)
*H04R 1/02* (2006.01)

(52) U.S. Cl.
CPC ..... *H04R 1/1008* (2013.01); *H04R 1/025* (2013.01); *H04R 1/1066* (2013.01); *H04R 5/033* (2013.01); *H04R 5/0335* (2013.01); *H04R 2201/107* (2013.01); *H04R 2205/021* (2013.01); *H04R 2420/07* (2013.01); *H04R 2420/09* (2013.01)

(58) Field of Classification Search
USPC ..... 381/74, 311, 370, 374, 375, 376, 379, 381/384
See application file for complete search history.

(56) References Cited

U.S. PATENT DOCUMENTS 7,155,025 B1 * 12/2006 Weffer ..... H04R 5/033 381/370
2007/0155313 A1 * 7/2007 Goldberg ..... G10H 1/0025 455/3.06
2011/0131358 A1 * 6/2011 Ganesh ..... G01C 21/265 710/304
2013/0238829 A1 * 9/2013 Laycock ..... H04R 1/1033 710/303
2016/0381452 A1 * 12/2016 Rodriguez ..... H04R 1/1041 381/370

* cited by examiner

*Primary Examiner* — Yosef K Laekemariam
(74) *Attorney, Agent, or Firm* — Patterson Intellectual Property Law, PC; Emily A. Shouse

(57) ABSTRACT

An audio system (10) has a headphone unit (12) and a speaker unit (14). The headphone unit is configured to receive wirelessly transmitted input signals from which an audio output is derived. The headphone unit is provided with a first connector unit (20) and the speaker unit is provided with a second connector unit (22). The speaker unit is configured to permit the headphone unit to be docked with the speaker unit so that the first connector unit and second connector unit connect to enable transmission of signals from the headphone unit to the speaker unit to enable the speaker unit to provide an audio output based on wireless input signals received by the headphone unit.

18 Claims, 4 Drawing Sheets

AUDIO SYSTEMS

BACKGROUND OF THE INVENTION

Field of the Invention

The invention relates to audio systems that may, for example, be used for outputting music or wireless audio conferencing.

SUMMARY OF THE INVENTION

The invention provides an audio system audio system comprising:

a headphone unit configured to receive wirelessly transmitted input signals and provide an audio output derived from said input signals and comprising a headband, an earphone and a first connector unit; and a speaker unit configured to provide an audio output and comprising a second connector unit, wherein said speaker unit is configured to permit said headphone unit to be docked with said speaker unit for said first connector unit to connect with said second connector unit enabling transmission of signals from said headphone unit to said speaker unit whereby said speaker unit provides an audio output based on said input signals.

The invention also includes an audio system comprising a headphone unit, a speaker unit and a connector system comprising a first connector unit provided on the headphone unit and a second connector unit provided on the speaker unit, wherein the headphone unit is configured to dock with the speaker unit to bring said first and second connector units into contact to enable at least one of:

i) transmission of electrical power from said speaker unit to said headphone unit; and ii) transmission of audio carrying signals from said headphone unit to said speaker unit from which signals an audio output is derived for output by said speaker unit.

The invention also includes a headphone unit comprising at least one SD card slot.

The invention also includes method of wireless audio conferencing comprising:

docking a headphone unit with a speaker unit to enable a first connector unit provided on said headphone unit to connect with a second connector unit that is provided on said speaker unit;

receiving a first signal at a mobile communications device and wirelessly transmitting a second signal containing audio data derived from said first signal from said mobile communications device to a wireless module of said headphone unit;

causing a third signal containing audio data derived from said second signal to be transmitted from said headphone unit to said speaker unit via said first and second connector units for audio output by said speaker unit.

The invention also includes an audio system comprising:

a headphone unit comprising a headband, an earphone, a first connector unit, a sound capturing device and a wireless module configured to receive wirelessly transmitted input signals and transmit output signals representative of sounds captured by said sound capturing device; and a speaker unit configured to provide an audio output and comprising a second connector unit, wherein said speaker unit is configured to permit said headphone unit to be docked with said speaker unit for said first connector unit to connect with said second connector unit to enable transmission of audio carrying signals from said headphone unit to said speaker unit via said connection units whereby said speaker unit is enabled to provide an audio output based on said wirelessly transmitted input signals, and wherein said headphone unit further comprises a control unit configured to determine when said headphone unit is docked with said speaker unit and cause said wireless module to operate respective different wireless transmission protocols to transmit said output signals when said headphone unit is docked with said speaker unit and when said headphone unit is not docked with said speaker unit.

BRIEF DESCRIPTION OF THE DRAWINGS

In order that the invention may be well understood, some examples thereof, which are given by way of example only, will now be described with reference to the drawings in which.

DETAILED DESCRIPTION

Figure 1:
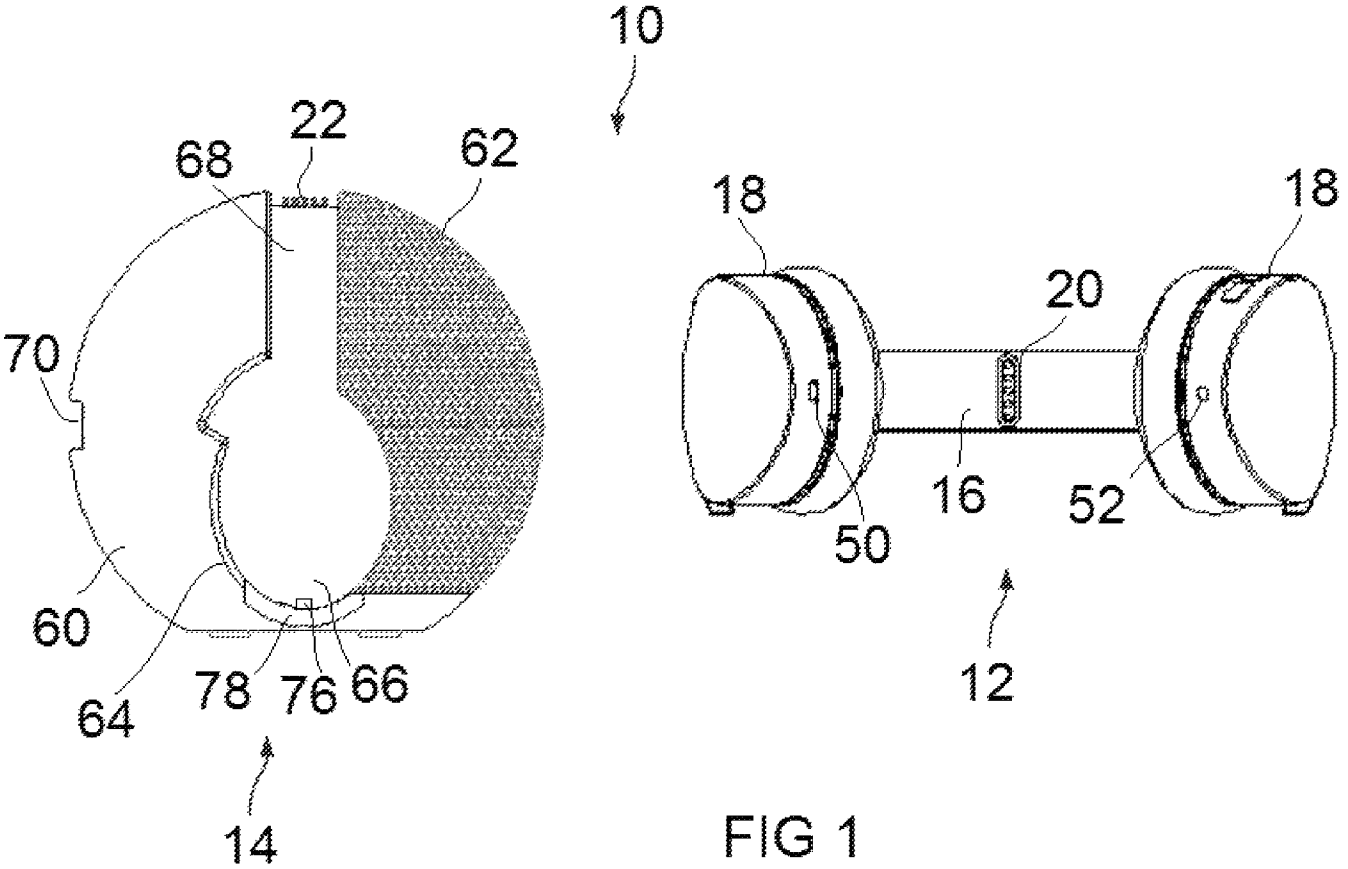
FIG. 1 shows a side view of a speaker unit and an underside view of a headphone unit of an audio system.

Referring to FIG. 1, an audio system 10 comprises a headphone unit 12 and a speaker unit 14. The headphone unit 12 is configured to receive wirelessly transmitted input signals and provide an audio output derived from the input signals. The headphone unit 12 comprises a headband 16, an earphone 18 and a first connector unit 20. Although not essential, in the example illustrated by FIG. 1 the headphone unit 12 has two earphones 18 disposed at respective ends of the headband 16. The speaker unit 14 is configured to provide an audio output and comprises a second connector unit 22. The speaker unit 14 is additionally configured to permit the headphone unit 12 to be docked with the speaker unit for the first connector unit 20 to connect with the second connector unit 22 to enable transmission of audio carrying signals from the headphone unit to the speaker unit via the first and second connector units whereby the speaker unit is enabled to provide an audio output based on the aforementioned wirelessly transmitted input signals.

Figure 2:
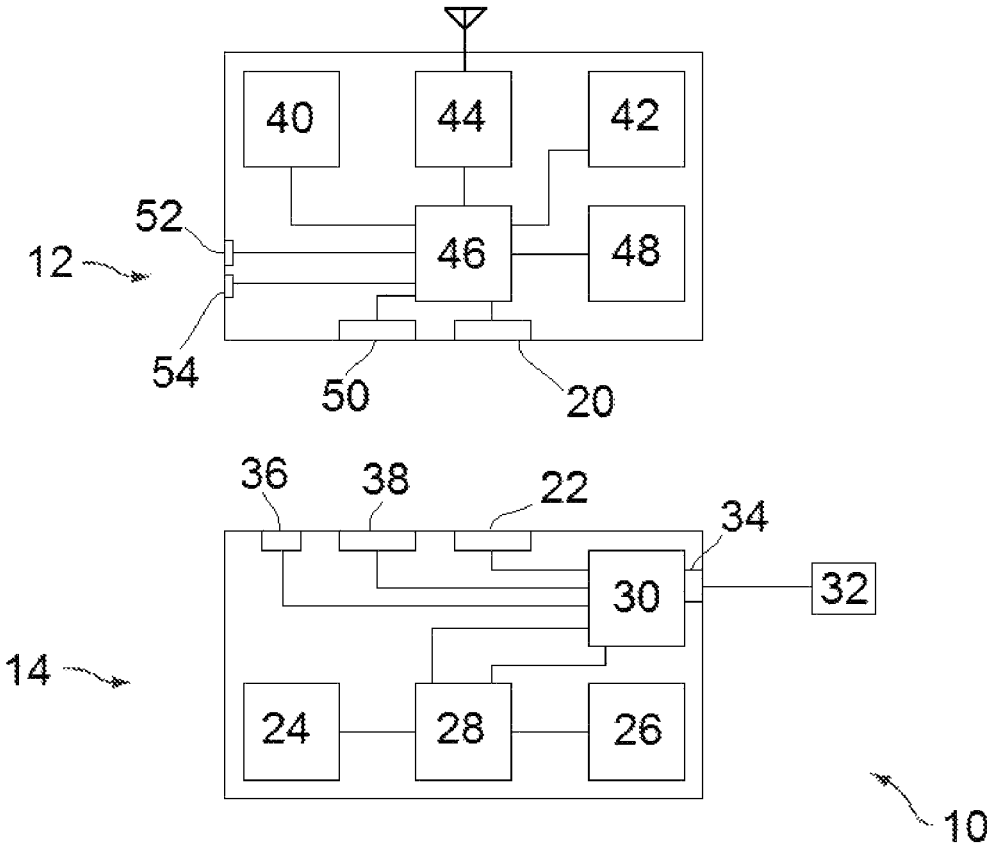
FIG. 2 is a schematic representation of elements of the audio system of FIG. 2.

Referring to FIG. 2, the speaker unit 14 may comprise a left speaker 24 and a right speaker 26 and an amplifier 28 connected with the two speakers. The speaker unit 14 may additionally comprise a control unit 30. The control unit 30 may comprise power distribution circuitry for receiving electrical current supplied from a power adapter 32. As known in the art, the power adapter 32 may comprise an AC to DC plug transformer suitable for plugging into a socket of a mains electrical supply circuit to convert the AC mains input into a suitable dc power output to power the speaker unit 14. The power adapter 32 may be provided with an output plug (not shown) to be plugged into an electrical input socket 34 provided on the speaker unit 14. The power distribution circuitry may be configured to distribute the DC power received from the power adapter 32 to the second connector unit 22 and the amplifier 28. The power distribution circuitry may be configured to further condition the DC current received from the power adapter 32 to match the requirements of the various powered components of the speaker unit 14.

The speaker unit 14 may additionally comprise a power on/off switch 36 and one or more auxiliary inputs 38. The or each auxiliary input 38 is connected with the control unit 30 and configured to allow the speaker unit 14 to receive input signals from external devices such as CD players, personal computers, MP3 players, Smartphones and other devices capable of outputting input signals for audio output by the speaker unit. An auxiliary input 38 may, for example, comprise a socket for receiving a 3.5 mm jack plug. Additionally, or alternatively, the speaker unit 14 may be provided with a wireless module (not shown) to receive wirelessly transmitted input signals from such external devices wirelessly. The wireless module may be configured to receive one or more of WiFi®, Bluetooth® and cellular wireless signals as desired.

The headphone unit 12 comprises respective speakers 40, 42 housed in the earphones 18. The headphone unit 12 further comprises a wireless module 44 and a control unit 46. The wireless module 44 is configured to receive wireless input signals from which an audio output that is to be output by the earphone speakers 40, 42 is derived. The control unit 46 may be configured to decode the input signals to extract the audio content to form an audio signal to be output via the earphone speakers 40, 42. The wireless module 44 may, for example, be configured to receive signals transmitted using a WiFi protocol, a Bluetooth® protocol or via a cellular mobile communications network.

The headphone unit 12 also comprises a rechargeable power unit 48. The rechargeable power unit 48 may comprise one or more rechargeable batteries, for example, a 300 mAh Li Polymer battery. The control unit 46 is connected with the rechargeable power unit 48 and may comprise electrical distribution circuitry to, for example, conduct electrical current to power the wireless module 44. The headphone unit 12 is provided with an electrical charging port 50 to enable charging of the rechargeable power unit 48 by, for example, a suitable power adapter (not shown). The power adapter may be at least similar to the power adapter 32 described above. The electrical distribution circuitry in the control unit 46 may be configured to receive electrical power input via the electrical charging port 50 and conduct it to the rechargeable power unit 48. The electrical charging port 50 may, for example, be a micro USB charging port.

The headphone unit 12 may be provided with an auxiliary input 52 for direct connection to external devices such as CD players, personal computers, MP3 players, Smartphones or other suitable devices capable of providing a signal for audio output by the earphone speakers 40, 42.

The headphone unit 12 may optionally be provided with a sound capturing device which may comprise one or more microphones 54. In examples in which the headphone unit 12 is provided with a microphone 54, the wireless module 44 may be configured to wirelessly transmit signals representative of sounds captured by the microphone 54.

Although not limited to this specification, in a presently preferred example, the wireless module 44 may be configured to operate the Bluetooth Specification v4.1 with support for the A2DP 1.1 and AVRCP 1.4 profiles and the Bluetooth Handsfree Profile 1.6.

Referring to FIG. 1, the speaker unit 14 may comprise a speaker housing 60, which houses the speakers 24, 26, amplifier 28 and control unit 30. The housing 60 may comprise one or more plastics mouldings provided with mountings to which the speakers 24, 26 are secured. The speakers 24, 26 may be of any suitable configuration and power output. Although two speakers are shown in FIG. 2, it is to be understood that the speaker unit 14 may be provided with any desired number of speakers, including just one. The speaker unit 14 may additionally comprise at least one passive resonator (not shown). A cloth speaker net 62 may be provided to cover the speakers 24, 26.

The speaker housing 60 is provided with at least one docking formation 64 to facilitate docking of the headphone unit 12 with the speaker unit 14. In the example shown in FIG. 1, there is a docking formation 64 in the form of recessing defined by the speaker housing 60 (only half of which can be seen in FIG. 1—the other half extending down the opposite side of the speaker housing and being at least substantially a mirror image of the half visible in FIG. 1). The recessing comprises oppositely disposed earphone receiving portions 66 that are each configured to at least partially receive respective earphones 18 and an elongate headband receiving portion 68 extending between the earphone receiving portions and configured to least partially receive the headband 16.

The speaker housing 60 may be provided with a recess 70 disposed generally opposite the cloth speaker net 62. The electrical input socket 34, power on off switch 36 and one or more auxiliary inputs 38 may be housed in the recess 70. The second connector unit 22 is disposed in the headband receiving portion 68 of the docking formation 64 such that when the headphone unit 12 is docked with the speaker unit 14 so that the headband 16 is at least partially received in the headband receiving portion, the first and second connector units 20, 22 engage, or contact, to enable signal and power transmission between the headphone unit and the speaker unit. In the illustrated example, the first connector unit 20 is provided centrally on the headband 16, midway between the earphones 18. This is not essential and in other examples the first connector unit 20 may be disposed to one side of the headband 16 so that the second connector unit 22 may be disposed to one side of the speaker unit 14 where, for example, this is desirable for routing connections to circuitry in the speaker unit.

The first and second connector units 20, 22 may form a contact connector system. In the illustrated example, the first connector unit 20 may comprise a plurality of discrete contact pads and the second connector unit 22 may comprise respective resiliently loaded bodies that press against the contact pads when the first and second connector units engage. The first and second connector units 20, 22 may comprise a Pogo® pin connector system. The first and second connectors unit 20, 22 may respectively comprise three contactors for transmitting audio and control signals from the headphone unit 12 to the speaker unit 14 and two contactors for transmitting electrical power from the speaker unit to the headphone unit.

In use, the headphone unit 12 may be worn on the head to enable the wearer to hear an audio output derived from input signals received wirelessly by the wireless module 44. The input signals may be provided by any suitable device, such as a personal computer, Smartphone or MP3 player, that is equipped to wirelessly transmit signals to the headphone unit 12 for audio output via the earphones 18. The headphone unit 12 may also be docked with the speaker unit 14. When docked, the first and second connector units 20, 22 are pressed into engagement, or contact, to establish a transmission path between the headphone unit 12 and speaker unit 14. Once the transmission path is established, electrical current from the power adapter 32 may power the headphone unit 12 and recharge the rechargeable power unit 48. Simultaneously, audio carrying and control signals may be transmitted from the headphone unit 12 to the speaker unit 14 via the first and second connector units 20, 22 so that an audio output normally output through the earphones 18 is instead output by the speakers 24, 26.

In simple examples in which the speaker unit 14 is not configured to operate with external devices, the control units 30, 46 may be configured such that when the headphone unit 12 is docked with the speaker unit 14, charging of the rechargeable power unit 48 and the transmission of the audio and control signals to the speaker unit commence automatically. Thus, when docked and without further action from the user, the headphone unit 12 is automatically powered by the power adapter 32 via the speaker unit 14 while the rechargeable power unit 48 is simultaneously recharged and the audio output that would otherwise be output by the headphone unit is output by the speaker unit. In examples in which the speaker unit 14 is configured to receive input from external devices, whether via the auxiliary input 38 or an onboard wireless module, the headphone unit 12 is configured as the master unit so when it the headphone unit is docked with the speaker unit, signals from the headphone unit have priority over signals from external devices when the headphone unit is docked with the speaker unit. In examples in which the speaker unit has an onboard wireless module, this may be turned off when the headphone unit is docked with the speaker unit.

Figure 3:
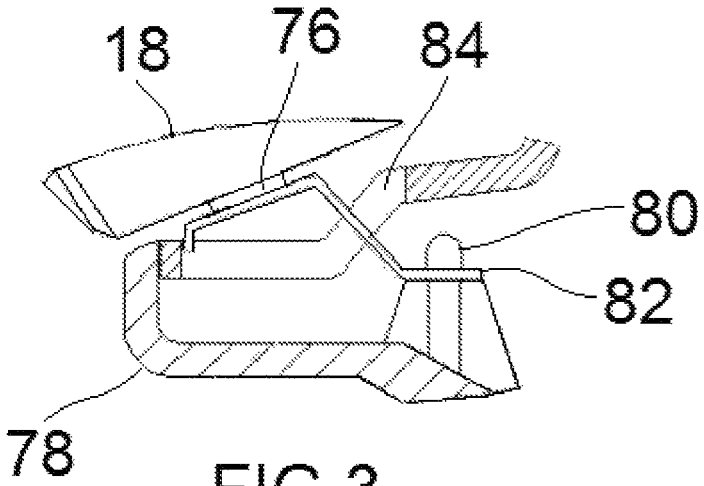
FIG. 3 is an enlargement of a portion of the speaker unit and headphone of FIG. 1 showing an example of a magnetic securing system.

Referring to FIGS. 1 and 3, the audio system 10 may be provided with a magnetic securing system for releasably securing the docked headphone unit 12 to the speaker unit 14. The magnetic securing system may take any convenient form and may, for example take the form of respective magnet units 76 provided on the speaker unit 14 to engage adjacent metal portions of the earphones 18. The magnetic locking system assists in ensuring good contact is maintained between the first and second connector units 20, 22. In the example illustrated by FIGS. 1 and 3, the speaker housing 60 has respective wing portions 78 disposed adjacent the lower ends of the earphone receiving portions 66 of the docking formation 64. A post 80 is secured within each wing portion 78 and respective mounting brackets 82 secured to the posts extend through openings 84 provided in the wing portions. At least one magnet unit 76 is secured to each mounting bracket 82. The magnet units 76 face upwardly so as to be engageable by metal portions of the earphones 18 so that the headphone unit 12 is releasably secured in its docked condition by magnetic attraction. It will be understood that as an alternative, or in addition, to the magnet units 76 shown in FIG. 3, magnet units may be provided on the speaker unit 14 in other locations in or adjacent the docking formation 64. For example, when the first connector unit 20 is disposed in the headband 16 it may be desirable to provide one or more magnet units adjacent the first and second connector units 20, 22.

Figure 4:
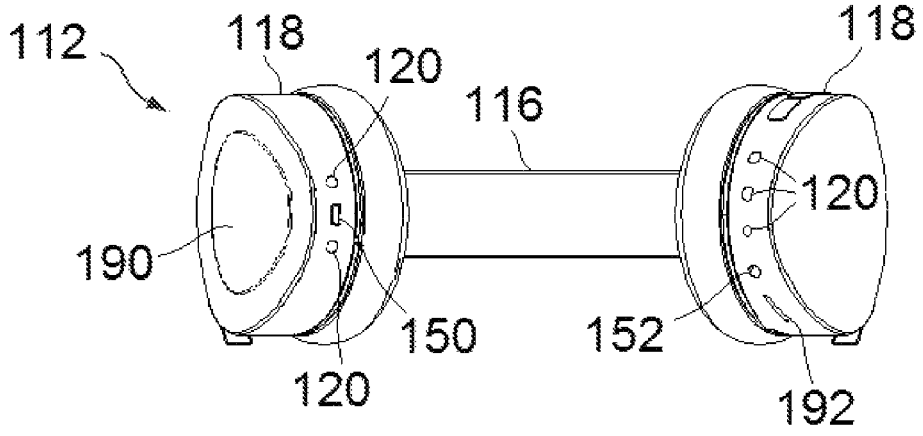
FIG. 4 shows the underside of another headphone unit.

FIG. 4 shows another headphone unit 112. The headphone unit 112 differs from the headphone unit 12 in the location of the first connector unit and by the incorporation of some additional features. Accordingly, to avoid unnecessary repetition of description, features similar, or identical, to those already described in connection with the audio system 10 are identified by the same reference numeral incremented by 100 and may not be described in detail again.

In the example shown in FIG. 4, the first connector unit 120 is no longer provided on the headband 116, but is instead provided on one or both earphones 118. Although in some examples all of the contactors of the first connector unit 120 may be provided on just one earphone 118, in the illustrated example, they are split between the two earphones. Specifically, one earphone 118 (the right hand as viewed in FIG. 4) is provided with three contactors to receive the audio carrying and control signals from the speaker unit and the other earphone 118 (the left hand as viewed in FIG. 4) is provided with two contactors to receive electrical power.

Figure 5:
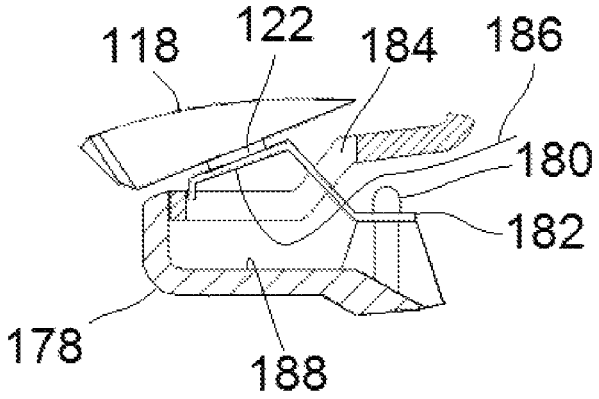
FIG. 5 is a view corresponding to FIG. 3 showing modifications to the speaker unit of FIGS. 1 to 3 to allow operation with a headphone unit as shown in FIG. 4.

Referring to FIG. 5, for use with the headphone unit 112 the positioning of the second connector unit 122 on the speaker unit is changed as compared with FIG. 1 in order to allow contact, or engagement, between the first and second connector units 120, 122 when the headphone unit is docked. As illustrated in FIG. 4, contactors of the second connector unit 122 may be provided on the mounting brackets 182 and suitable wiring 186 provided to connect to the control unit of the speaker unit. In examples provided with a magnet securing system, it may be desirable to position the magnetic units elsewhere on the speaker unit to allow space for the contactors of the second connector unit 122 on the mounting brackets 182. In some examples, rather than providing contacts on mounting brackets as shown in FIG. 4, the second connector unit may be mounted directly on the wing portions 178, for example to the surface 188. For example, resiliently loaded pins of a Pogo® connector system may be mounted on the surface 188 so as to project outwardly of the opening 184.

Referring to FIG. 4, the outwardly facing major surface of one of the earphones 118 may be provided with a pivoting plate 190 configured to act as a control pad for inputting commands to the headphone unit 112. The pivoting plate 190 may be configured to pivot in four directions corresponding to north, south, east and west, which may respectively be used to input volume up, volume down, play/pause and forward/backward commands. Alternatively, or additionally, buttons or dials may be provided on the headband 116 or earphones 118 to provide the same or similar functions. Although not shown in the drawings, it is to be understood that a control pad similar to, or the same as, the pivoting pad 190 may be provided on one or both earphones 18 of the headphone unit 12.

Still referring to FIG. 4, the headphone unit 112 may be provided with an auxiliary input in the form of an SD card slot 192 connected with the control unit to permit the use of the headphone unit to playback stored music or other audio material stored on an SD card or to store music or other audio material on such a card. It is to be understood that while this is not shown in the drawings, the headphone unit 12 may similarly be provided with an auxiliary input in the form of an SD card slot.

Figure 6:
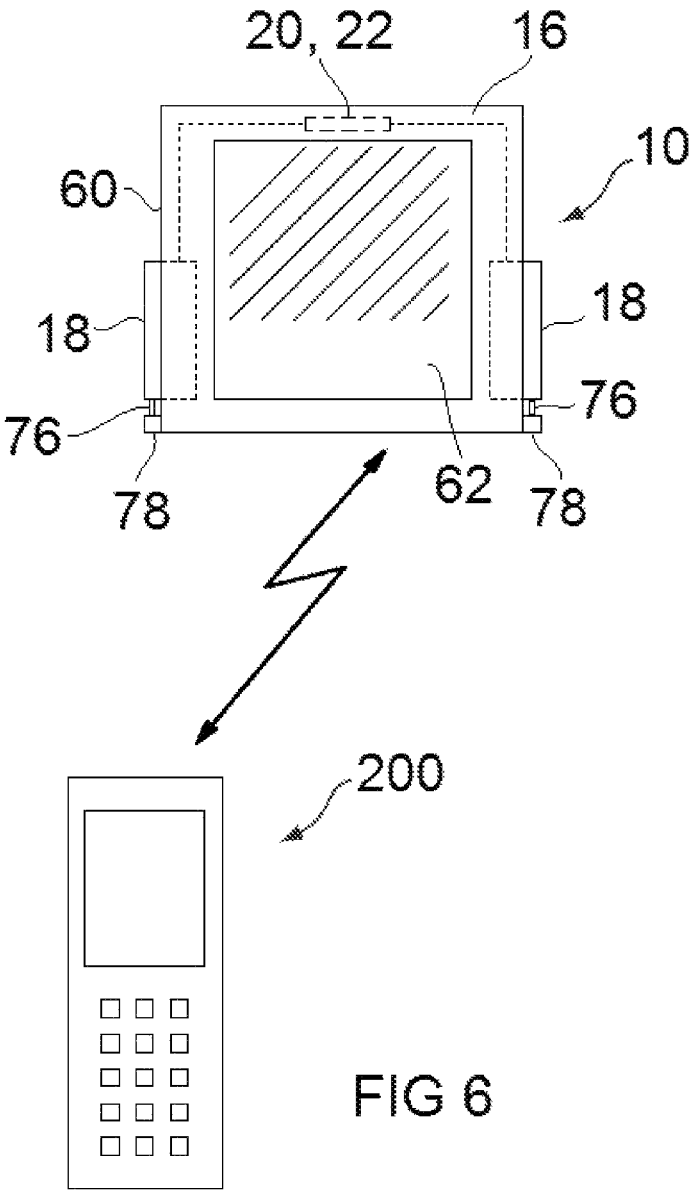
FIG. 6 illustrates use of the audio system of FIG. 1 for conferencing.

Referring to FIGS. 1, 2 and 6, the audio system 10 may be used for wireless audio conferencing. As shown, the headphone unit 12 is docked with the speaker unit 14 so that the first and second connectors 20, 22 contact and provide a transmission path between the headphone and speaker units. A mobile telecommunications handset 200 such as a Smartphone may receive a call from a remote telecommunications device and transmit this wirelessly to the wireless module 44. Because the headphone unit 12 is docked with the speaker unit 14, the control unit 46 of the headphone unit 12 causes a signal representative of the audio content of the wirelessly received signals and a control signal to be transmitted to the control unit 30 of the speaker unit 14 via the first and second connectors 20, 22, which causes an audio output derived from the incoming wirelessly received signals to be output via the speakers 24, 26 of the speaker unit. This provides the possibility of a better quality and potentially louder audio output than would be obtainable by switching the mobile communications handset 200 to 'speakerphone'.

In examples of the headphone unit 12 that do not have a microphone, the inbuilt microphone of the mobile communications handset 200 can be used directly for responding to the incoming calls. Advantageously the headphone unit 12 may incorporate a microphone 54 as shown in FIG. 2. In examples of the audio system 10 in which the headphone unit 12 has a microphone 54, responses to incoming calls can be made via the microphone 54 making it easier for a number of people to take part in conference call. To facilitate improved quality audio transmissions from the audio system 10, the wireless module 44 may be configured to operate two Bluetooth Hands Free Protocol CVC versions, one for use when headphone unit 12 is in headset mode and one for when it is docked with the speaker unit 14. The different protocols are selected to take account of the different operating environments affecting the microphone, which will be located close to the audio input (the wearer's mouth) when operating in headset mode and, at least potentially, more distant when the headphone unit 12 is docked with the speaker unit 14.

The control unit 46 may be configured to detect when the headphone unit 12 is operating in headset mode and when it is docked and cause the wireless module to operate the correct Hands Free Protocol according to whether the headphone unit is docked or undocked. In some examples, the control unit 46 may detect when the headphone unit 12 is docked by detecting the presence of electrical current input from the speaker unit 14 via the first connector unit 20. In other examples, the headphone unit 12 may be provided with a movable member that is moved against a resilient biasing member when the headphone unit is engaged with the speaker unit 14 and acts to change an electrical signal received by the control unit 46 It may also be necessary configure the control unit 46 to condition the signal from the microphone 54 to remove or, at least reduce speaker echo that may be picked up when the headphone unit 12 is docked with the speaker unit 14 and the microphone 54 is active. The control unit 46 may, for example, comprise a processor configured to operate a signal cleaning algorithm to remove speaker echo and related noise from the signals provided by the microphone 54.

It will be understood that providing for the headphone unit to be charged by the speaker unit allows the possibility of the user continuing to listen to music or other audio output via the speaker unit while the rechargeable power unit of the headphone unit is recharged. Thus, there is no loss of utility when the rechargeable power unit needs to be recharged. Furthermore, it means that a charger cable is not needed and the user does not have the task of finding and connecting the headphone unit to a charger cable every time the rechargeable power unit needs to be recharged.

It will be understood that a magnetic securing system is not essential as the docking formation may be configured such that the flexibility and resilience of the headphone unit will cause it to clamp onto the docking formation. However, a magnetic securing system may prove advantageous in maintaining the contact between the respective connector units of the headphone unit and speaker unit. It will also be understood that while a magnetic securing system may advantageously be used to secure the headphone unit to the speaker unit, a suitable non-magnetic securing system may be used instead. For example, the speaker unit or headphone unit may be provided with one or more catches or latches configured to engage suitable locking formations provided on the other unit. In some examples, the catches or latches may be made of a plastics material and may be configured to be inherently resilient to allow engagement and disengagement with the locking formations by push-fitting or snap-fitting. In other examples, the catches or latches may be biased into a locking position by suitable biasing elements such as, for example, compression or torsion springs.

In the illustrated example the docking formation comprises recessing that at least partially receives the headphone unit. In some examples, the docking formation may be configured such that when docked the outermost surfaces are at least substantially flush with the exterior of the speaker unit. It will be understood that in some examples the docking formation may comprise projections that engage recesses provided in the headphone unit or a combination or projections and recessing.

It is to be understood that while in the illustrated examples the headphone unit comprises two earphones, in some examples there may be just one headphone.

In some examples, the audio system may comprise a plurality of speaker units of which just one or a plurality may be configured to enable docking with the headphone unit. The or each speaker unit configured to dock with the headphone unit may be configured to relay the input signal from a docked headphone unit to the other speaker units in the audio system over peer-to-peer (for example Bluetooth® or WiFi Direct®) and WiFi AP architectures. This provides the possibility of having the headphone unit provide an input signal providing multi-room audio output.

In some examples, the control unit of the headphone unit may be configured to operate in response to user voice input captured by the sound capturing device. For example, the control unit may be configured to switch the audio path from the headphone unit to the speaker unit in response to voice commands. Additionally, or alternatively, the control unit may be configured to provide other voice command functionality such as play, pause and volume increase/decrease.

What is claimed is:

1. An audio system comprising:

a headphone unit configured to receive wirelessly transmitted input signals and provide an audio output derived from said input signals and comprising a headband, an earphone and a first connector unit; and a speaker unit configured to provide an audio output and comprising a second connector unit, wherein said speaker unit is configured to permit said headphone unit to be mounted to the speaker unit to dock the headphone unit with said speaker unit to connect said first connector unit with said second connector unit to enable transmission of audio carrying signals from said headphone unit to said speaker unit whereby said speaker unit is enabled to provide an audio output based on said wireless transmitted input signals, wherein said headphone unit is provided with a sound capturing device and a wireless module configured to receive said wirelessly transmitted input signals and wirelessly transmit output signals representative of sound captured by said sound capturing device to a mobile communications device for transmission by said mobile communications device to a remote telecommunications device by said mobile communications device.

2. An audio system as claimed in claim 1, wherein said headphone unit is powered by a rechargeable power unit and said first connector unit and second connector unit are configured to conduct electrical current such that said rechargeable power unit is rechargeable by electrical current output by said speaker unit via said first and second connector units.

3. An audio system as claimed in claim 1, wherein said first and second connector units form a contact connector system.

4. An audio system as claimed in claim 1, wherein at least a part of said first connector unit is provided on said headband.

5. An audio system as claimed in claim 1, wherein at least a part of said first connector unit is provided on said earphone.

6. An audio system as claimed in claim 1, wherein said speaker unit comprises a speaker housing provided with a docking formation engageable by said headphone unit.

7. An audio system as claimed in claim 6, wherein said docking formation comprises recessing defined by said speaker housing to at least partially receive at least one of said headband and said earphone.

8. An audio system as claimed in claim 7, wherein said second connector unit is disposed in said recessing.

9. An audio system as claimed in claim 1, further comprising a securing system for releasably securing said headphone unit to said speaker unit with said first connector unit connected with said second connector unit.

10. An audio system as claimed in claim 1, wherein said headphone unit is provided with a control unit configured to cause said wireless module to operate respective different signal conditioning profiles to transmit said output signals when said headphone unit is docked with said speaker unit and when said headphone unit is not docked with said speaker unit.

11. An audio system as claimed in claim 10, wherein said control unit is configured to operate a signal cleaning algorithm to clean signals received from said sound capturing device when said headphone unit is docked with said speaker unit.

12. An audio system comprising:

a headphone unit comprising a headband, an earphone, a first connector unit, a sound capturing device and a wireless module configured to receive wirelessly transmitted input signals and wirelessly transmit output signals representative of sounds captured by said sound capturing device; and a speaker unit configured to provide an audio output and comprising a second connector unit, wherein said speaker unit is configured to permit said headphone unit to be mounted to the speaker unit to dock the headphone unit with said speaker unit to connect said first connector unit with said second connector unit to enable transmission of audio carrying signals from said headphone unit to said speaker unit via said connection units whereby said speaker unit is enabled to provide an audio output based on said wirelessly transmitted input signals, and wherein said headphone unit further comprises a control unit configured to cause said wireless module to operate respective different wireless transmission protocols to wirelessly transmit said output signals when said headphone unit is docked with said speaker unit and when said headphone unit is not docked with said speaker unit.

13. An audio system as claimed in claim 12, wherein said control unit is configured to operate a signal cleaning algorithm to clean signals received from said sound capturing device when said headphone unit is docked with said speaker unit.

14. An audio system as claimed in claim 12, wherein said speaker unit is provided with at least one docking formation comprising a recess or projection configured to mate with at least a portion of said headphone unit.

15. A method of wireless audio conferencing comprising:

mounting a headphone unit to a speaker unit to dock the headphone unit with the speaker unit so that a first connector unit provided on said headphone unit connects with a second connector unit that is provided on said speaker unit;

receiving a first signal at a mobile communications device and wirelessly transmitting a second signal containing audio data derived from said first signal from said mobile communications device to a wireless module of said headphone unit;

causing a third signal containing audio data derived from said second signal to be transmitted from said headphone unit to said speaker unit via said first and second connector units for audio output by said speaker unit; and capturing sounds with a sound capturing device provided on said headphone unit and causing said wireless module to wirelessly transmit output signals representative of sounds to said mobile communications device.

16. A method as claimed in claim 15, further comprising transmitting said second signal using a Bluetooth protocol.

17. A method as claimed in claim 15, wherein said wireless module is configured to wirelessly transmit using respective different signal conditioning profiles according to whether the headphone unit is docked with said speaker unit or not docked with said speaker unit and further comprising detecting whether the headphone unit is docked or not docked and causing said wireless module to transmit said fourth signal using the respective signal conditioning profile.

18. A method as claimed in claim 15, further comprising detecting a change in an electrical current to detect when said headphone unit is docked with said speaker unit.

* * * * *